United States Patent [19]

Ostling

[11] 4,026,211

[45] May 31, 1977

[54] HOLLOW-CHARGE SHELL AND ANTITANK WEAPON FOR SAID SHELL

[75] Inventor: Hans Martin Ostling, Eskilstuna, Sweden

[73] Assignee: Forenade Fabriksverken, Eskilstuna, Sweden

[22] Filed: Mar. 5, 1976

[21] Appl. No.: 664,066

[30] Foreign Application Priority Data

Mar. 7, 1975 Sweden ..... 7502568

[52] U.S. Cl. ..... 102/24 HC; 102/56 SC; 102/76 P; 102/78; 102/DIG. 2

[51] Int. Cl.[2] ..... F42B 13/10; F42C 15/34

[58] Field of Search ..... 102/24 HC, 56 SC, DIG. 2, 102/76 R, 78

[56] References Cited

UNITED STATES PATENTS

| | | | |
|---|---|---|---|
| 3,280,743 | 10/1966 | Reuther | 102/24 HC |
| 3,732,818 | 5/1973 | Thomanck | 102/56 SC |

FOREIGN PATENTS OR APPLICATIONS

| | | | |
|---|---|---|---|
| 1,124,550 | 7/1956 | France | 102/24 HC |
| 1,359,513 | 3/1964 | France | 102/24 HC |
| 2,067,683 | 7/1971 | France | 102/DIG. 2 |

*Primary Examiner*—Verlin R. Pendegrass
*Attorney, Agent, or Firm*—Fleit & Jacobson

[57] ABSTRACT

Hollow-charge shell and antitank weapon for said shell, the shell being provided with an adjustable safety device that is automatically adjusted from a safety position to an armed position at the discharge of the shell, bringing a blasting cap contained in said safety device to its initiation position, wherein blocking means will give two alternative armed positions, one giving a symmetrical initiation of the hollow-explosive charge and a narrow explosive beam and the other giving an unsymmetrical initiation of the hollow-explosive charge and thus a broader explosive beam.

5 Claims, 5 Drawing Figures

HOLLOW-CHARGE SHELL AND ANTITANK WEAPON FOR SAID SHELL

Figure 1:
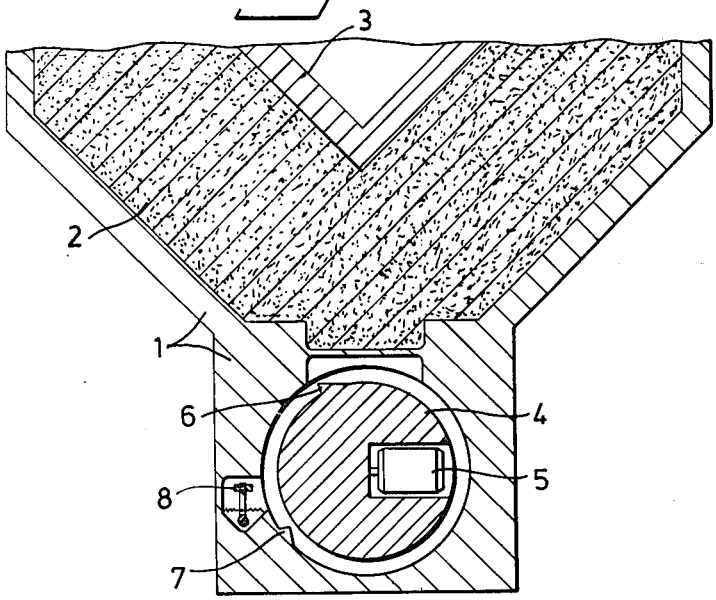
Figure 2:
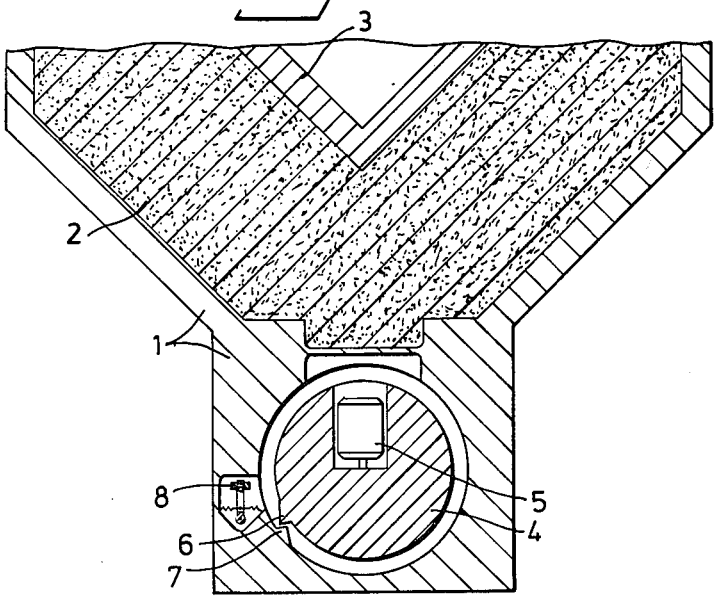
Figure 3:
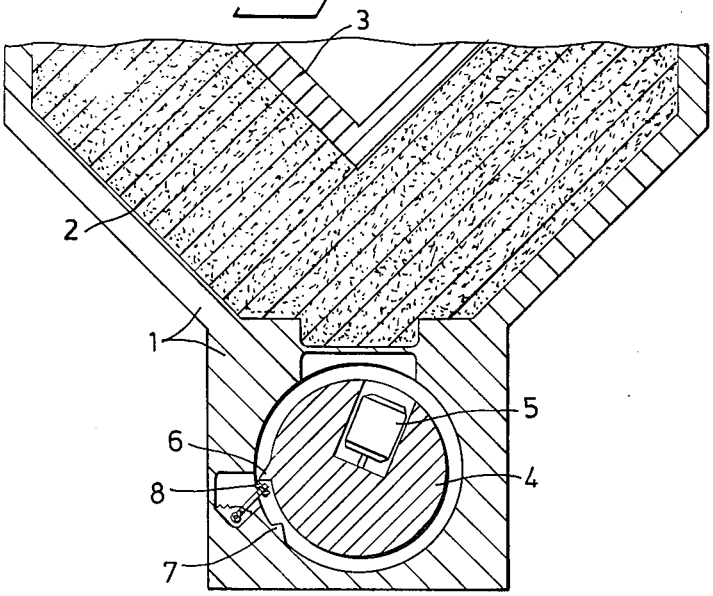

The present invention relates to a hollow-charge shell and an antitank weapon for said shell, the shell being provided with an adjustable safety device. Said device is devised to become automatically turned from a safety position to an armed position at the discharge of the shell and thereby to bring a blasting cap contained in the safety device to the initiation position thereof in an ignition line to initiate the hollow-explosive charge. The safety device may for instance be a rotor or a slide.

A shell with a hollow charge effect should at combatting targets provided with thick armour give a narrow explosive beam of a large penetration depth. When combatting targets provided with a thin armour, a broader explosive beam gives a satisfying penetration depth and an increased surface effect on the target. Thus it is desirable to use shells with an effect adapted according to the type of target.

It is known per se from U.S. Pat. No. 3,732,818 (FIG. 4) to achieve at a hollow-explosive charge a broader explosive beam than is normal by means of an eccentric instead of central initiation of the charge.

Utilizing these known circumstances it is an object of the present invention to provide a shell of the mentioned type that is adjustable for use at different types of targets.

In order to obtain an explosive beam of a width adapted to the different targets the shell is according to the invention provided with blocking means to limit the adjusting movement of the safety device to two alternative armed positions, in which one position the longitudinal axis of the blasting cap coincides with that of the shell to bring about a symmetrical initiation of the explosive charge, and in which second position the longitudinal axis of the blasting cap forms an angle with the longitudinal axis of the shell to bring about an unsymmetrical initiation of the explosive charge.

It is apparent that a shell adjustable in this way does not only give the advantage of a one-type ammunition that can be used for combatting targets of different armour thicknesses but also the great advantage that a shell, already placed in the weapon and adapted to the combatting of tanks, can be readily adjusted for the firing at armoured caterpillars or the opposite way without having to be removed from the weapon.

To achieve alternative initiation positions for the blasting cap the shell is provided with a movable blocking means for the adjustable safety device. The blocking means, that for instance may be a bolt, slide, balance arm or pendulum, is devised to be influenced by an adjusting device.

The invention will now be described in more detail with reference to the attached drawing. FIGS. 1 – 5 are longitudinal sectional views through those parts of the shell that are relevant to the invention.

The casing of the shell is designated with 1, the hollow-explosive charge with 2 and the conical metal lining coaxial with the central axis of the shell with 3. A rotor 4 is turnably carried in the casing. The rotor contains a blasting cap 5. Under the influence of a not shown spring the rotor is turnable 90° from a safety position according to FIG. 1 to an armed position according to FIG. 2. In this armed position the longitudinal axis of the blasting cap coincides with the central axis of the shell. In order that the rotor will stop in the correct position when being turned, the rotor is provided with a stop 6 that strikes against a stop 7 in the casing. According to the invention the casing is provided with a blocking device 8, which is devised to stop the turning of the rotor in a position according to FIG. 3, where the longitudinal axis of the blasting cap forms a small angle with the central axis of the shell. Thus an oblique initiation of the hollow charge is achieved, which leads to a broader explosive beam than is obtained when the longitudinal axis of the blasting cap coincides with the central axis of the shell.

The rotor 4 may be rplaced with a displaceable slide, in which case the blocking device is arranged to stop the slide, when being displaced from a safety position to an armed position, in a position where the longitudinal axis of the blasting cap does not fully coincide with the central axis of the shell, which gives an eccentric initiation.

Figure 4:
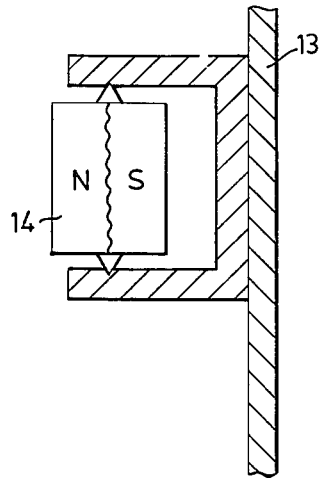
Figure 4:
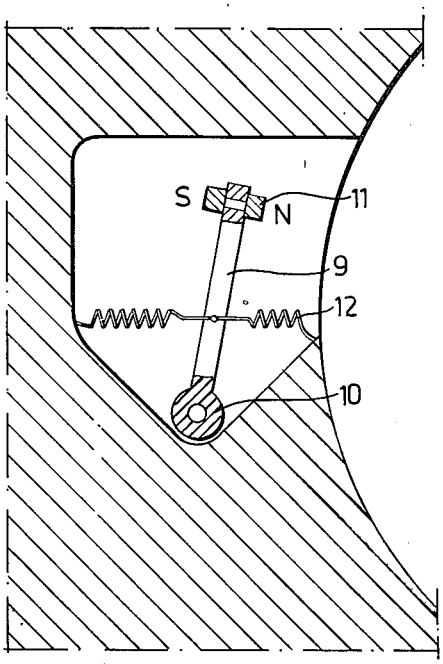

An embodiment of the blocking device is shown in FIG. 4. The blocking device consists of a sheet of tin-plate 9. The rear end of the sheet of tin-plate is turnably carried in the casing at 10. The front end of the sheet of tin-plate is provided with a permanent magnet 11. If the magnet is uninfluenced, the sheet of tin-plate is kept in a neutral position by means of two helical springs 12. In order to influence the magnet there is used a turnable permanent magnet 14 placed outside the barrel wall 13, which magnet is brought to take the shown position, when one wishes to use the blocking device. The magnet 11 is then displaced towards the right, and by means of the acceleration of the shell the blocking device will fulfill its movement to the right, whereafter a not shown catch will lock the blocking device in such a position that the blocking device can stop the turning of the rotor in the position that is evident from FIG. 3. If the turnable magnet 14 is brought to take its second position, the magnet 11 will be displaced towards the left, which has as a result that the blocking device cannot stop the turning of the rotor.

Figure 5:
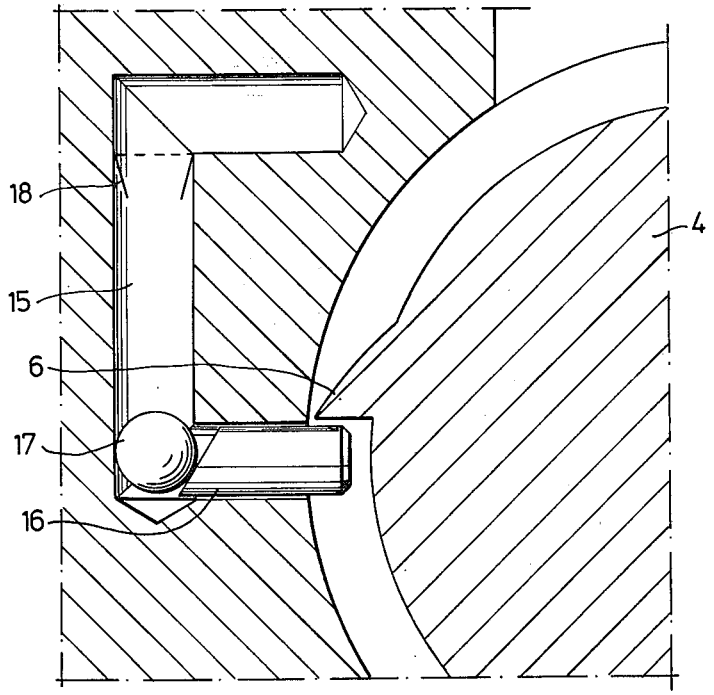

Another embodiment of the blocking device is shown in FIG. 5. The casing of the shell is provided with a channel 15 that forms two right angles. The lower, in the drawing horizontal part of the channel is open in the direction toward the rotor. In said part there is a bolt 16, that when being displaced towards the right can stop the turning of the rotor because the rotor stop 6 will strike against the bolt. In the channel there is a ball 17, which before the discharge of the shell will be located in the upper horizontal part of the channel. The two horizontal parts of the channel are connected with each other by means of a vertical part. At the connection between the upper horizontal part and the vertical part there is a membrane 18. If the shell (weapon) is turned somewhat clockwise seen from behind before the firing, the ball will be located to the far right in the upper part of the channel. Any blocking of the turning of the rotor by means of the bolt will then not occur. If the shell (weapon) is turned somewhat counter-clockwise seen from behind before the firing, then the ball will be located at the far left in the upper part of the channel. At the acceleration of the shell the ball will break through the membrane and strike with force against the bevelled part of the bolt, so that the bolt is displaced to its blocked position, as is shown in FIG. 5.

The weapon is provided with sight members movably attached on the barrel. The sight members are adjustable between two end positions, and in said positions they indicate the correct turning positions of the weapon, as the sight members must always be directed upward at firing.

What is claimed is:

1. A hollow-charge shell of the type having a hollow explosive charge and anti-tank weapon for the shell comprising, in combination, an adjustable safety device provided with a blasting cap, said safety device being mounted on the shell for adjusting movement between a safety position and into either of two armed positions with said blasting cap in an ignition line for initiation of the hollow-explosive charge upon the discharge of the shell, blocking means mounted on the shell for selectively limiting the adjusting movement of said safety device to said two armed positions, said blocking means being arranged to selectively limit the movement of said safety device to one of said armed positions wherein the longitudinal axis of said blasting cap coincides with the central axis of the shell to bring about a symmetrical initiation of the explosive charge or to the other of said armed positions wherein the longitudinal axis of said blasting cap forms an angle with the central axis of the shell to bring about an unsymmetrical initiation of the explosive charge.

2. A shell and anti-tank weapon for the shell as defined in claim 1 wherein said blocking means comprises a blocking device movably housed in the shell, an adjusting device for operatively conditioning said blocking device for movement into an active blocking position to limit the adjusting movement of said safety device to one of said armed positions or into a passive position for permitting the adjusting movement of said safety device to the other of said armed positions.

3. A shell and anti-tank weapon for the shell as defined in claim 2 wherein said adjusting device comprises a magnet having a magnetic field for operatively conditioning said movable blocking device for movement of said blocking device into said active or passive positions.

4. A shell and anti-tank weapon for the shell as defined in claim 3 wherein said magnet is movably attached on the outside of the barrel of the weapon.

5. A shell and anti-tank weapon for the shell as defined in claim 2 wherein said adjusting device comprises a ball, means for movably housing said ball in the shell, said ball being arranged to be moved in said housing means into one of a position before firing of the shell where it will have no influence on said movable blocking means and a position where the acceleration of the shell at the firing will permit said ball to operatively condition said movable blocking device for movement into said active blocking position.

* * * * *